US008410997B2

(12) United States Patent
Lee

(10) Patent No.: US 8,410,997 B2
(45) Date of Patent: Apr. 2, 2013

(54) DRIVING CIRCUIT, DRIVING METHOD AND PLASMA DISPLAY PANEL HAVING SCAN LINE GROUPS RECEIVING RESET SIGNALS AT DIFFERENT TIMES

(75) Inventor: Sang-gu Lee, Suwon-si (KR)

(73) Assignee: Samsung SDI Co., Ltd, Yongin-si, Gyeonggi-Do (KR)

( * ) Notice: Subject to any disclaimer, the term of this patent is extended or adjusted under 35 U.S.C. 154(b) by 768 days.

(21) Appl. No.: 12/005,779

(22) Filed: Dec. 27, 2007

(65) Prior Publication Data

US 2008/0259062 A1 Oct. 23, 2008

(30) Foreign Application Priority Data

Apr. 23, 2007 (KR) ..... 10-2007-0039340

(51) Int. Cl.
*G09G 3/28* (2006.01)
*G09G 3/10* (2006.01)

(52) U.S. Cl. ..... 345/60; 315/169.4

(58) Field of Classification Search ..... 345/68, 345/60; 315/169.4
See application file for complete search history.

(56) References Cited

U.S. PATENT DOCUMENTS 6,208,081 B1 * 3/2001 Eo et al. ..... 345/60
2004/0012547 A1 * 1/2004 Lee ..... 345/60
2005/0078058 A1 * 4/2005 Loh ..... 345/60
2005/0195132 A1 * 9/2005 Chung et al. ..... 345/60
2005/0259039 A1 * 11/2005 Kim et al. ..... 345/60
2007/0057869 A1 * 3/2007 Choi ..... 345/60
2007/0132671 A1 * 6/2007 Choi ..... 345/68
2007/0139307 A1 * 6/2007 Yeo ..... 345/68
2007/0222708 A1 * 9/2007 Park ..... 345/60

FOREIGN PATENT DOCUMENTS

JP 2002-140031 5/2002
JP 2002-333860 11/2002
JP 2006-058799 3/2006
KR 10-2003-14883 2/2003
KR 10-2005-0102845 A 10/2005
KR 10-659128 B1 * 12/2006
KR 10-2007-0034774 A 3/2007
KR 10-2007-0059331 A 6/2007

OTHER PUBLICATIONS

Notice of Allowance issued on Aug. 11, 2008 from the Korean Intellectual Property Office in Korean Application No. 10-2007-0039340.
Korean Office Action issued on Mar. 24, 2008 in Korean Patent Application 9-5-2008-015868103.

* cited by examiner

*Primary Examiner* — Adam J Snyder
(74) *Attorney, Agent, or Firm* — Knobbe Martens Olson & Bear, LLP

(57) ABSTRACT

A PDP driving circuit is disclosed. The circuit includes a scan driver divided into at least more than two groups, a logic controller generating scan driver control reference signals, which are used to generate scan driving signals of the scan driver, and a buffer block giving different delay times to the scan driver control reference signals, to apply them to the scan driver groups, respectively.

21 Claims, 12 Drawing Sheets

| | | | | | | |
|---|---|---|---|---|---|---|
| OC1_even | H | H | H | H | H | L |
| OC1_odd | H | H | L | H | H | H |
| OC2 | L | H | L | L | L | H |
| State | 1 | 2 | 5 | 1 | 1 | 3 |

| | | | | | | |
|---|---|---|---|---|---|---|
| OC1_even | H | H | H | H | H | L |
| OC1_odd | H | H | H | H | H | H |
| OC2_A | L | H | L | L | L | H |
| OC2_B | L | H | H | L | L | H |
| State | 1 | 2 | 6 | 1 | 1 | 3 |

| OC1 | H | H | H | H | H | L |
|---|---|---|---|---|---|---|
| OC2_1 | L | H | H | L | L | H |
| OC2_etc | L | H ->->->->-> | H | L ->->->->-> | L | H |
| State | 1 | 2 ->->->->-> | 2 | 1 ->->->->-> | 1 | 3 |

DRIVING CIRCUIT, DRIVING METHOD AND PLASMA DISPLAY PANEL HAVING SCAN LINE GROUPS RECEIVING RESET SIGNALS AT DIFFERENT TIMES

CROSS-REFERENCE TO RELATED APPLICATION

This application claims the benefit of Korean Patent Application No. 10-2007-0039340, filed on Apr. 23, 2007, in the Korean Intellectual Property Office, the disclosure of which is incorporated herein by reference.

BACKGROUND

1. Field

The present invention relates to a driving circuit and a driving method for a plasma display panel (PDP), and more particularly to a driving circuit and a driving method capable of reducing the generation of sudden large current in a reset period of scan driving signals.

2. Description of the Related Technology

A plasma display panel (hereinafter, referred to as a 'PDP') displays an image by light-emitting phosphors excited with ultraviolet light generated during the discharge of an inert mixed gas such as He+Xe, Ne+Xe, He+Ne+Xe, etc. This PDP can be easily made thin and large, and it can provide greatly increased image quality with the recent development of the relevant technology.

Referring to FIG. 1, the discharge cell of a three-electrode AC surface discharge type PDP includes scan electrodes Y1 to Yn, a sustain electrode X, and address electrodes A1 to Am perpendicular to the scan electrodes Y1 to Yn and the sustain electrode X.

A cell 1 for displaying any one of red, green, and blue is formed near an intersection of the scan electrodes Y1 to Yn, the sustain electrode X, and the address electrodes A1 to Am. The scan electrodes Y1 to Yn and the sustain electrode X are formed on an upper substrate, which is not shown.

A dielectric layer and MgO protective layer, which are not shown, are formed on the upper substrate. The address electrodes A1 to Am are formed on a lower substrate, which is not shown. Barrier ribs for preventing optical and electrical radio interference between horizontally neighboring discharge cells are formed on the lower substrate. A phosphor layer configured to be excited with an vacuum ultraviolet light to emit a visible light is formed on the substrate and the surface of the barrier ribs. An inert mixed gas such as He+Xe, Ne+Xe, He+Ne+Xe, etc. is injected into the discharge space between the upper substrate and the lower substrate.

The PDP is driven with one frame being divided into several sub-fields having a different amount of emission in order to implement the gray scale of an image. Each of the sub-fields is divided into a reset period for initializing the whole screen, an address period for selecting a scan line and selecting a cell in the selected scan line to emit light, and a sustain period for implementing the gray scale according to the data. For example, if it is desired to display an image with 256 gray scales, a frame period (16.67 ms) corresponding to 1/60 second is divided into eight sub-fields SF1 to SF8, as shown in FIG. 2. Each of the sub-fields SF1 to SF8 is subdivided into a reset period, an address period, and a sustain period, as described above. The reset period and the address period of each of the sub-fields are overlapping in every sub-field, whereas the sustain period and the number of sustain pulses allocated thereto increase in the ratio of $2^n$ (where, n=0,1,2,3,4,5,6,7) in each sub-field.

The driving waveform of the PDP supplied to each sub-field is driven by being divided into a reset period for initializing whole screens, a address period for selecting a cell, and a sustain period for maintaining the discharge of the selected cell. The reset period generally generates a rising ramp waveform in a positive direction having large peak value, wherein there is a sudden flow of large current according to the rising ramp waveform. The sudden flow of large current lowers the discharge efficiency of the PDP and deteriorates driving quality.

In order to prevent the sudden flow of large current in the reset period, the Y electrodes are divided into two groups to be driven with the difference between a rising time point and a falling time point of the scan driving signals applied to each group in the reset period, making it possible to reduce the flow of current by half. However, regarding the generation of different scan driving signals in every group of the Y electrodes, the implementation thereof is not as easy and the burden in view of hardware is large so that the application to group the Y electrodes into more than two has not been widely used.

Also, regarding the generation of different scan driving signals in every group of the Y electrodes, as the size of a panel becomes large, the driving circuit part thereof should be greatly changed, resulting in that it may increase manufacturing costs.

SUMMARY OF CERTAIN INVENTIVE ASPECTS

One aspect is a PDP driving circuit including a logic controller generating a plurality of scan driver control reference signals, a buffer block having different delay times for each of the scan driver control reference signals, and a scan driver divided into at least three groups and configured to generate scan driving signals for each of the three groups based on each of the delayed-scan driver control reference signals.

Another aspect is a driving method for a PDP including a logic controller and a plurality of scan drivers. The method includes forming a plurality of scan driver control reference signals in a logic controller, the reference signals being digital signals, transferring the scan driver control reference signals to the scan drivers, the transferred reference signals having a delay time in at least one transition time point, forming scan driving signals according to the transferred scan driver control reference signals, and driving the PDP according to the scan driving signals.

Another aspect is a plasma display device including a PDP including a plurality of discharge electrodes, each of the discharge electrodes belonging to one of more than two groups, and a driving circuit module configured to separately drive each of the groups of discharge electrodes with driving signals each including a reset waveform, an address waveform, and a sustain waveform, where at least one of the reset waveform, the address waveform, and the sustain waveform is applied to each of the groups at a different time.

DETAILED DESCRIPTION OF CERTAIN INVENTIVE EMBODIMENTS

Hereinafter, embodiments will be described with reference to the accompanying drawings so that those skilled in the art can carry out the present invention. However, the embodiments may be modified in many different forms and the invention should be limited to the embodiments set forth herein.

Figure 1:
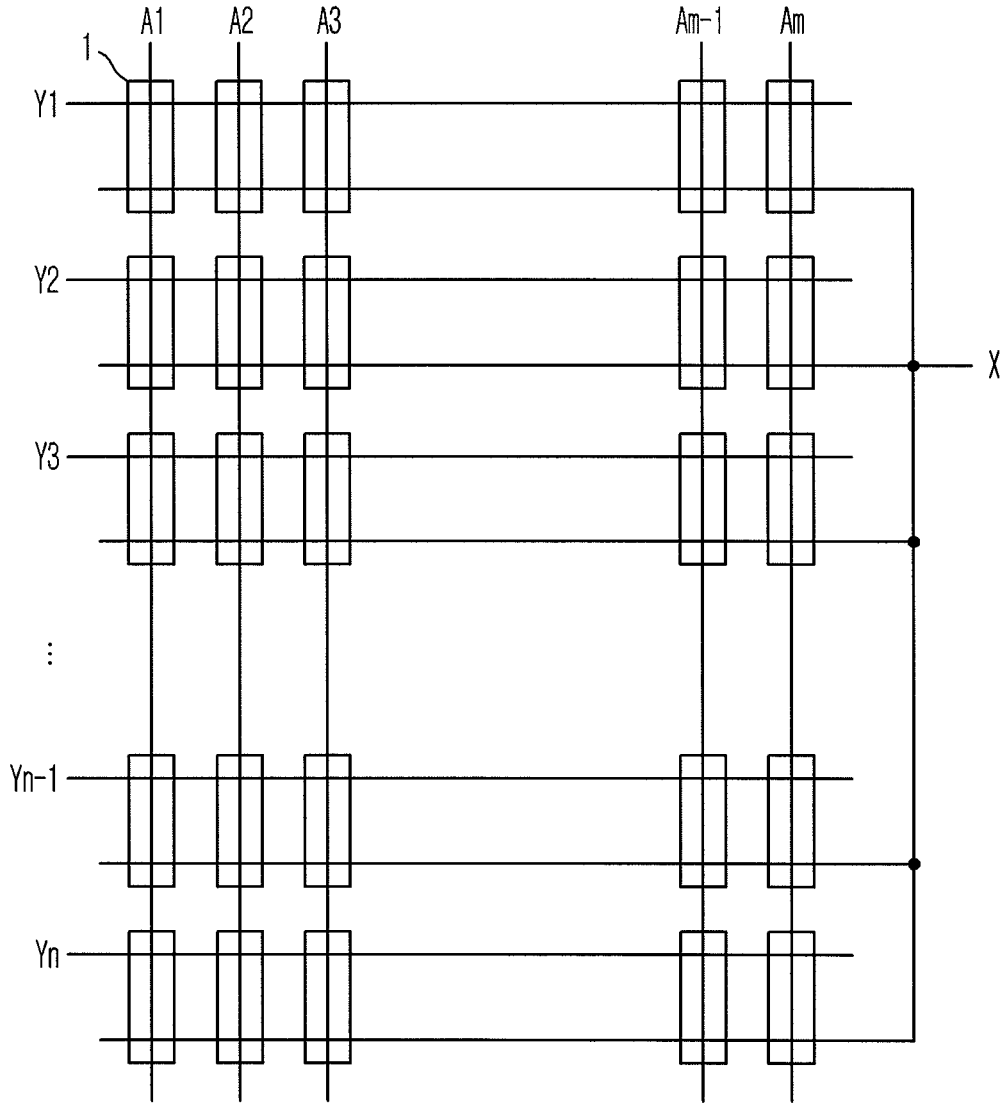
FIG. 1 (PRIOR ART)
FIG. 1 is a plan view schematically showing the electrode arrangement of a conventional three-electrode AC surface-discharge type PDP.
Figure 2:
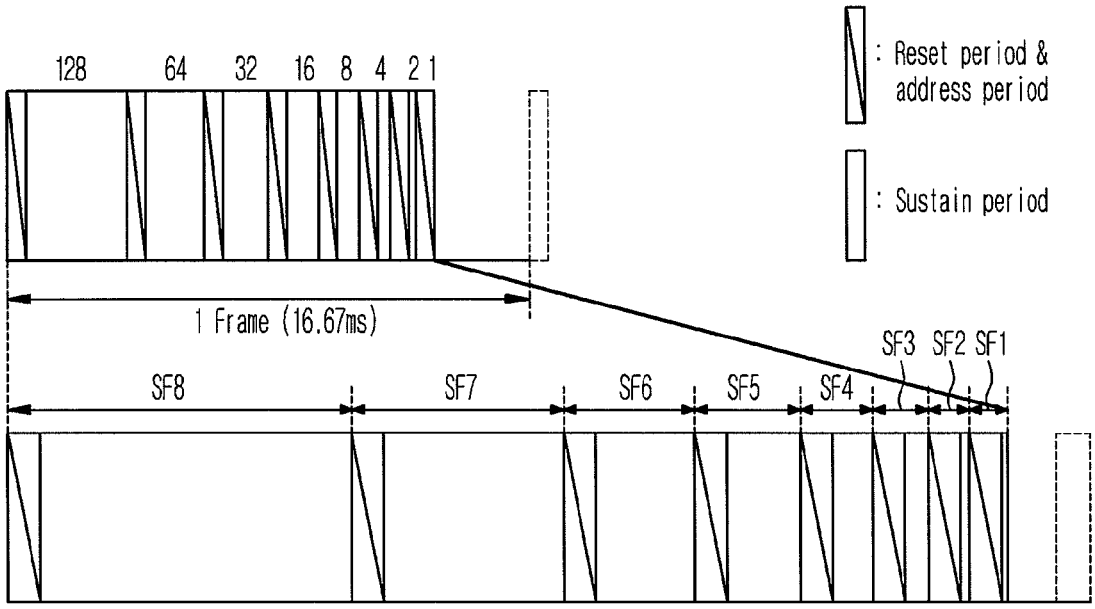
FIG. 2 (PRIOR ART)
FIG. 2 is a concept view showing the construction of a frame with a 8-bit default for implementing 256 gray scales.
Figure 3:
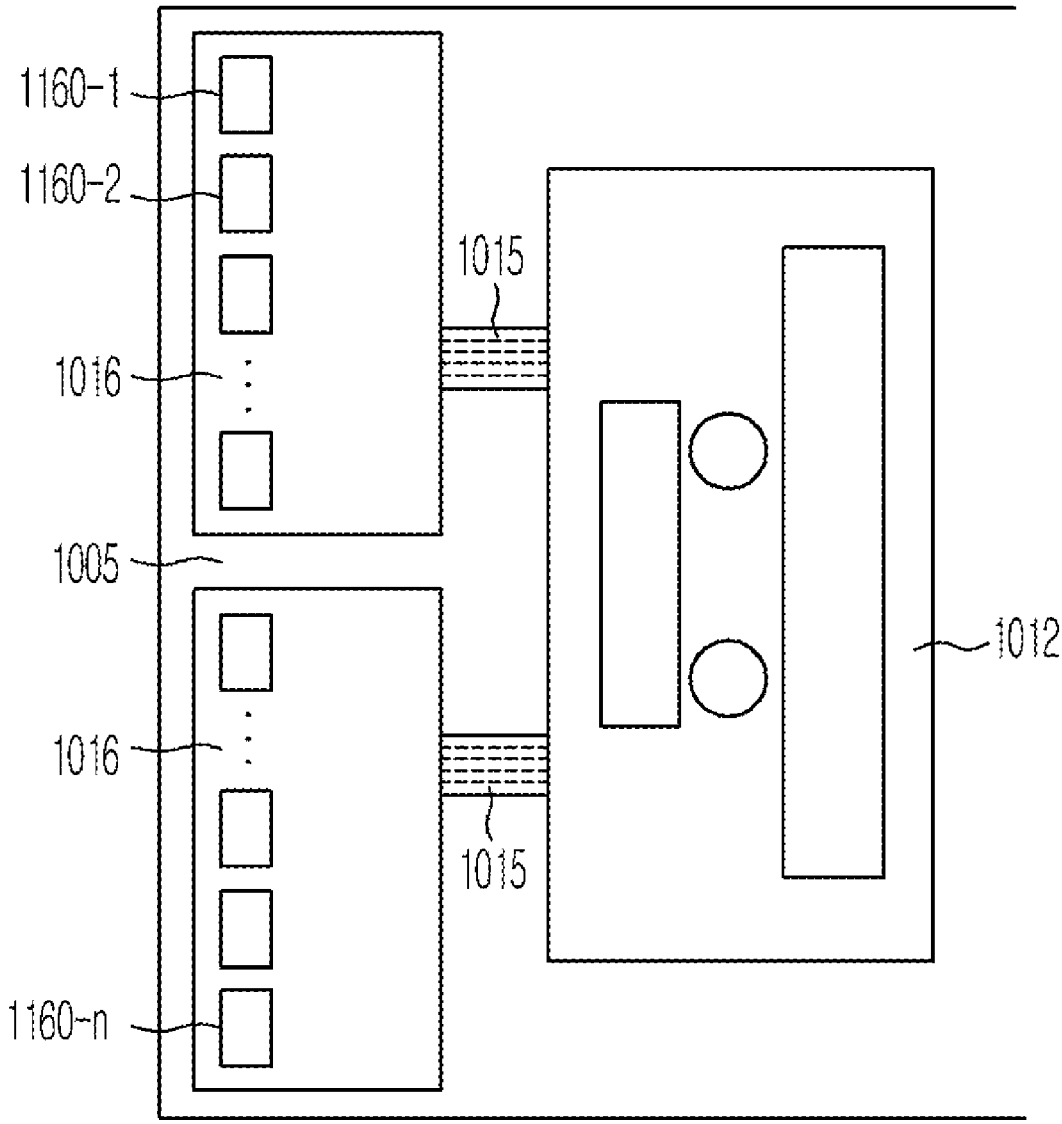
FIG. 3 is a construction view showing a PCB structure of a general plasma display device.

FIG. 3 is a partial plan construction view of a chassis base of a PDP panel.

Describing boards mounted on the rear of the chassis base 1005 with reference to FIG. 3, the Y board includes a driver board 1016 including a scan driver IC generating scan driving signals applied to Y electrodes of the PDP, that is, scan electrodes and a supporting circuit for the scan driver IC, and a controller board 1012 including a logic controller generating scan driver control reference signals controlling the operation that the scan driver IC generates the scan driving signals and a supporting circuit for the logic controller.

Although the driver board 1016 is described to include the scan driver IC, the mounting position of the scan driver IC can be, for example at the edge of a Y axis where the PDP is bonded to the chassis base. Also, although the controller board 1012 is described to include the logic controller, the mounting position of the logic controller can, for example, be the center of the chassis rather than the driver board 1016.

In one embodiment, features are included to relieve the generation of large current in a reset period by controlling control signals applied to the scan driver IC. Hereinafter, the scan driver IC-will simply be referred to as the scan driver.

The below Table 1 describes the operation of the driver IC according to the two control signals OC1 and OC2 applied to the scan driver IC. Operation in a reset period are described in the Table 1 below.

TABLE 1

| OC1 | OC2 | HVO state | Operation in a reset period |
|---|---|---|---|
| L | L | All HVOs Hi-Z | Maintaining as Vs |
| L | H | Inverse of Data | — |
| H | L | All HVOs GNEInverse of Data | Falling Ramp |
| H | H | All HVOs VH | Rising Ramp |

Figure 4:
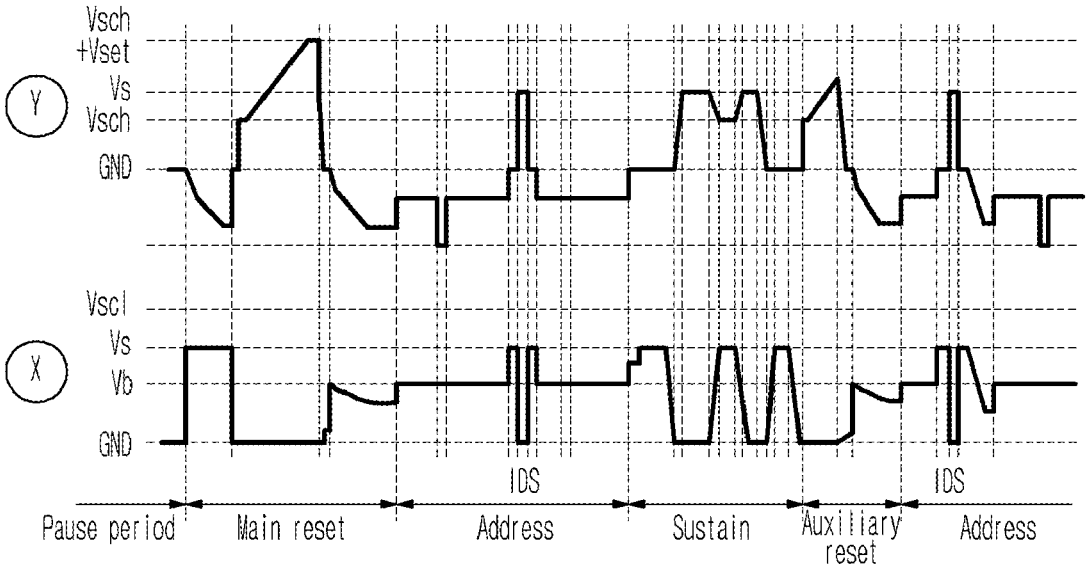
FIG. 4 is a waveform view showing driving signals for X electrodes and Y electrodes of a general PDP.

The relation between the scan driving signals output by one scan driver in an initial reset period for each screen to be displayed and the control signals will be described with reference to FIG. 4. The scan driver first generates a falling ramp waveform in a negative potential direction by receiving H and L to apply them to the Y electrodes of the panel, and then generates a rising ramp waveform initializing the reset of the panel in a positive potential direction by receiving H and L to apply them to the Y electrode of the panel, wherein the H and L is a combination of the second control signals OC1 and OC2. Thereafter, the scan driver generates a falling ramp waveform in a negative potential direction by receiving H and L again to apply them to the Y electrodes of the panel, thereby completing the operation in the reset period and starting the operation in the address period.

A structure to apply scan driving signals of different waveforms according to each group to the Y electrodes divided into two groups by controlling the control signals for the scan driver will be described.

Figure 5:
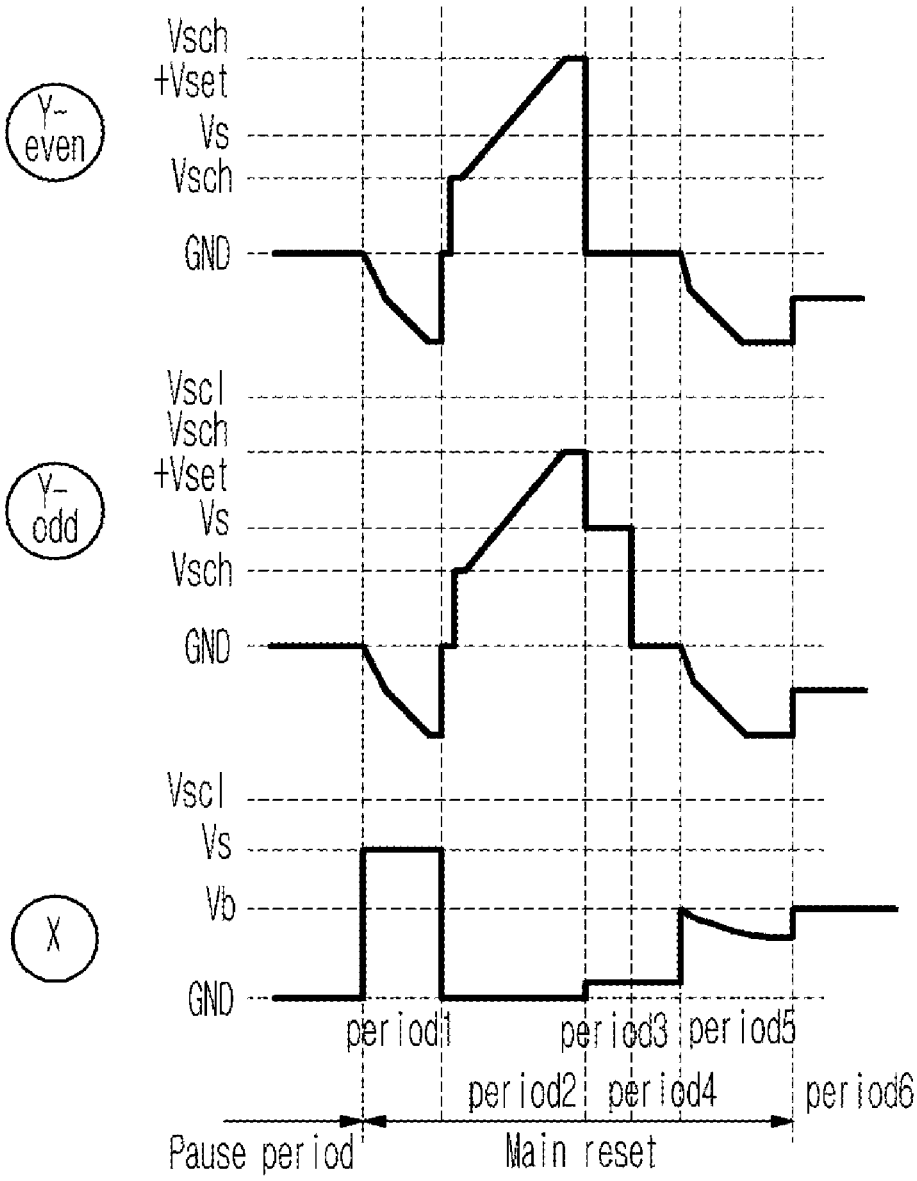
FIG. 5 is a waveform view showing one example driving the Y electrodes of the PDP by dividing them into two groups.

FIG. 5 shows one example of the scan driving signals reducing the generation of current in the reset period by applying different control signals from each other to an even driver and an odd driver.

In this case, the Y electrodes are grouped into an even electrode and an odd electrode and accordingly, the scan drivers are grouped into the even driver and the odd driver. As two control signals applied to the respective even and odd drivers, OC1_even and OC2_even signals are applied to the even driver and OC1_odd and OC2_odd signals are applied to the odd driver. However, OC2_even signal and OC2_odd signals are commonly used in FIG. 5 so that OC1_even and OC2 signals are applied to the even driver and OC1_odd and OC2 signals are applied to the odd driver. In the reset period, the control signals as shown in FIG. 5 are applied to the even driver and the odd driver so that the time point when the large current is generated from the even driver is different from the time point when the large current is generated from the odd driver, thereby making it possible to relieve the generation of the large current in the reset period by half thereof.

In FIG. 5 the even driver and the odd driver generate a falling ramp waveform in a period I and generate a rising ramp waveform for resetting in a period 2, and the even driver maintains a ground potential output and the odd driver maintains a Vs potential output in a period 3. Period 6 is for an address period.

Figure 6:
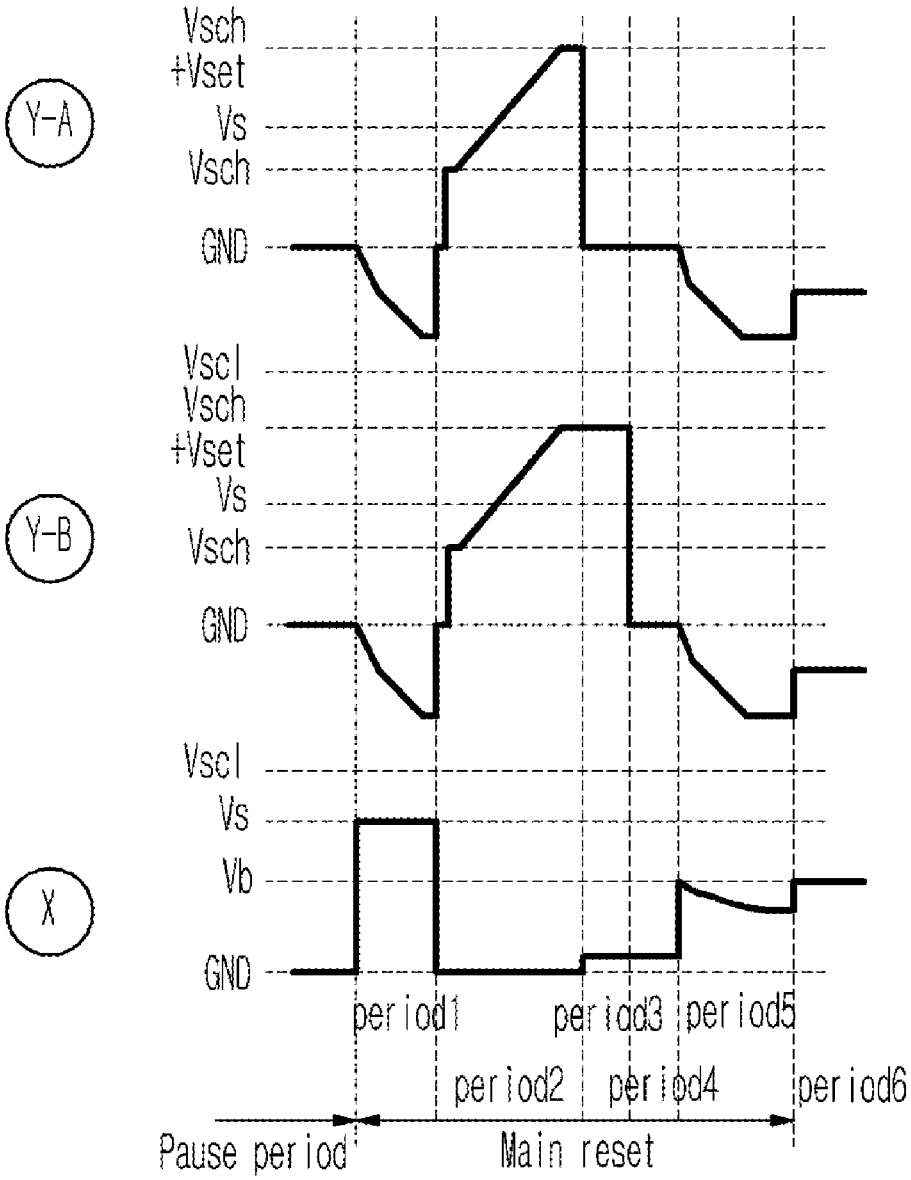
FIG. 6 is a waveform view showing another example driving the Y electrodes of the PDP by dividing them into two groups and driving them.

FIG. 6 shows another example of scan driving signals relieving the generation of the large current in the reset period by applying different control signals from each other to the even driver and the odd driver.

In the case of scan driving signals in FIG. 6, as two control signals applied to the respective even and odd drivers, OC1_even and OC2_A signals are applied to the even driver and OC1_odd and OC2_B signals are applied to the odd driver. In other words, four independent control signals OC1_even, OC2_A, OC1_odd, and OC2_B are applied.

Even in the case of FIG. 6, the time point when the large current is generated from the even driver is different from the time point when the large current is generated from the odd driver, thereby making it possible to relieve the generation of the large current in the reset period by half thereof. In FIG. 6 the even driver and the odd driver generate a falling ramp waveform in a period 1 and generate a rising ramp waveform for resetting in a period 2, and the even driver maintains a ground potential output and the odd driver maintains a highest potential of the rising ramp as it is in a period 3.

The states as shown in the table of FIGS. 5 and 6 are the states of the scan driver designated by the two control signals, wherein the relationship between the states and the two control signals may be varied according to sorts of the scan driver.

However, the methods in FIGS. 5 and 6 should separately form the control signals for two groups in a logic controller. Although in the case of two groups, the logic controller can be modified, although it may be complicated. If the number of groups is greater than two, another method should be used. In addition, when the size of the panel is sufficiently large, the generation of the large current is not sufficiently prevented dividing into two groups.

Figure 7:
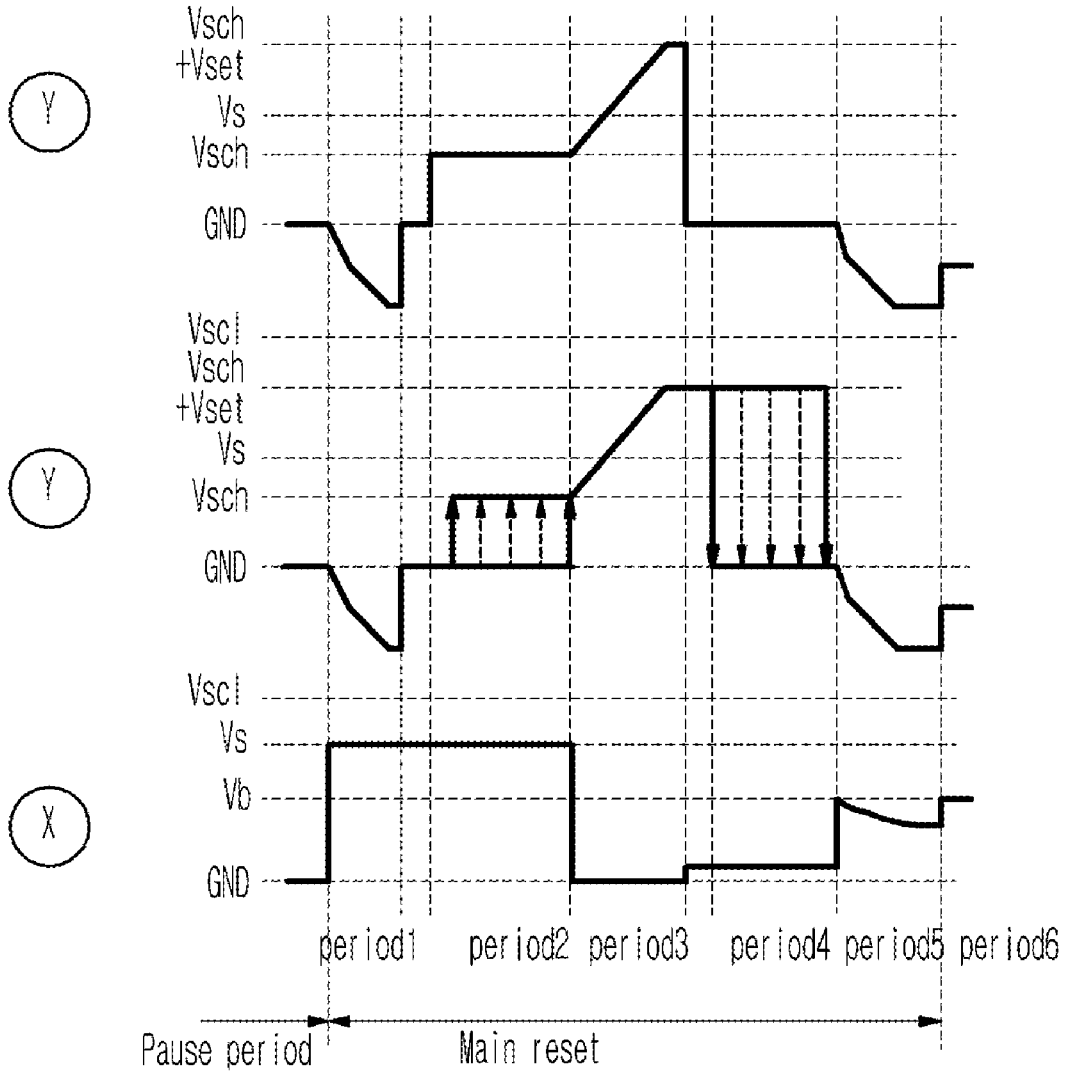
FIG. 7 is a waveform view showing one example driving the Y electrodes of the PDP using a delay time by dividing them into a plurality of groups.

FIG. 7 shows a plurality of scan driver signals different from each other to be applied to a plurality of scan driver groups.

Although the same control signals OC1 and OC2 are applied to the scan driver groups, different delay times from each other are applied according to each scan driver group.

The states as shown in the table of FIG. 7 are the states of the scan driver designated by the two control signals, wherein the relationship between the states and the two control signals may be varied according to attributes of the scan driver.

From FIG. 7, it can be appreciated that the rising time point of the reset waveform as well as the falling time point of the reset waveform is generated at different time points from each other according to each scan driver group. In FIG. 7, the rising ramp waveform is not generated right after the control signals OC1 and OC2 are transitioned into H and H, but the control signals first perform the preliminary level up that the driving waveform obtains Vsch potential according to the transition to H and H and then the rising ramp waveform is almost simultaneously generated from the whole scan drivers after predetermined time elapses. This is due to the relationship with an additional circuit for generating the rising ramp other than the scan drivers. Therefore, according to the implementation of the additional circuit, it can be implemented that the rising ramp is generated right after the control signals OC1 and OC2 are transitioned into H and H so that the rising ramp is generated at different time points from each other according to each scan driver group.

Figure 8:
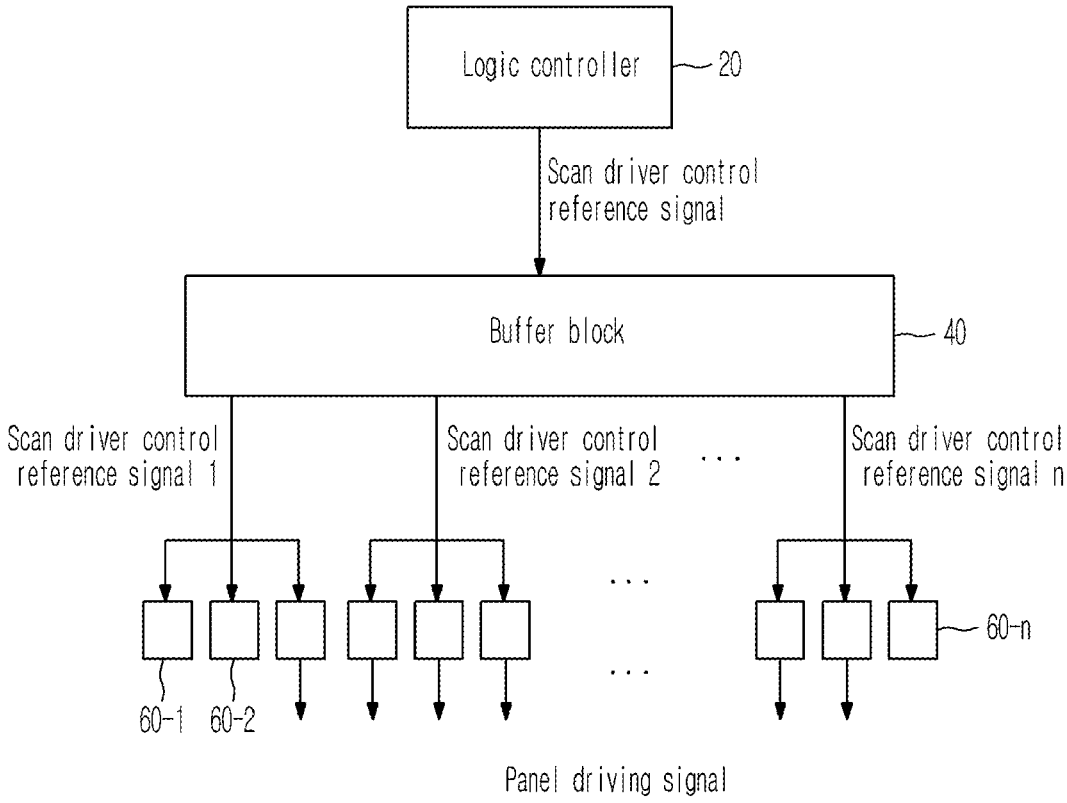
FIG. 8 is a block view showing one example of a PDP driving circuit.

FIG. 8 shows a driving circuit module generating scan driving signals from the scan driver control signals.

Describing in sequence of flow of signal, the driving circuit module includes a logic controller 20 generating scan driver control reference signals according to the prescribed reset policy. A buffer block 40 receiving the scan driver control reference signals outputs the signals by delaying them for a determined time. Scan drivers 60-1 to **60-*n* receiving the delayed scan driver control signals from the buffer block 40 to generate scan driving signals. Also, a delay controller (not shown) controlling the delay operation of the buffer block 40** can be further included therein.

Figure 9A:
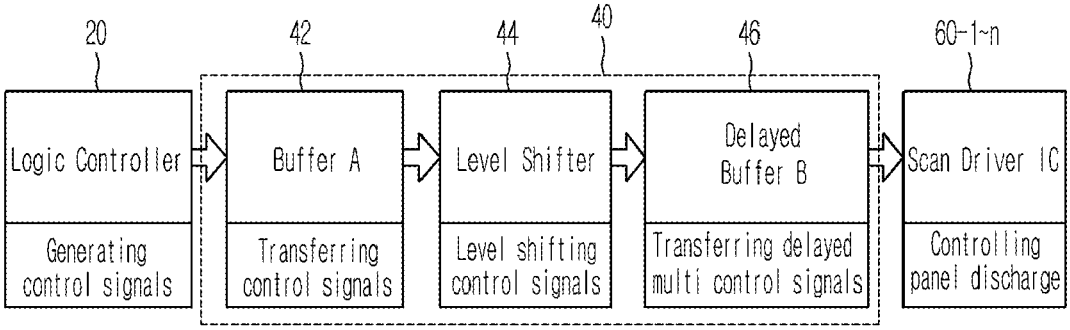
FIGS. 9*a* to 9*c* are block views showing implementing examples of the buffer block in FIG. 8.
Figure 9B:
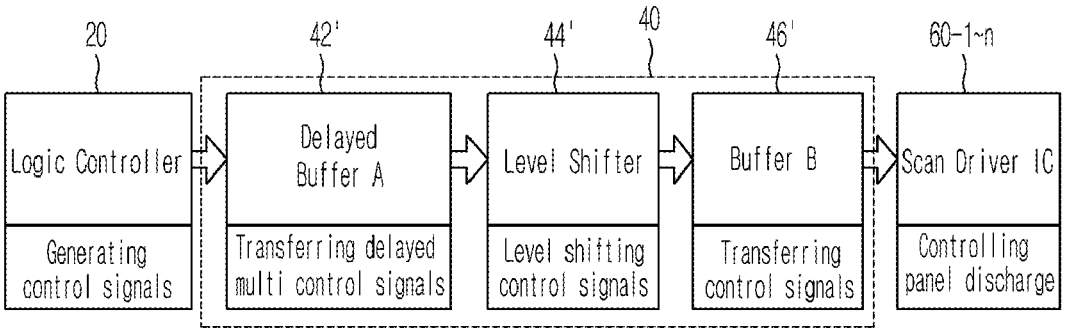
Figure 9C:
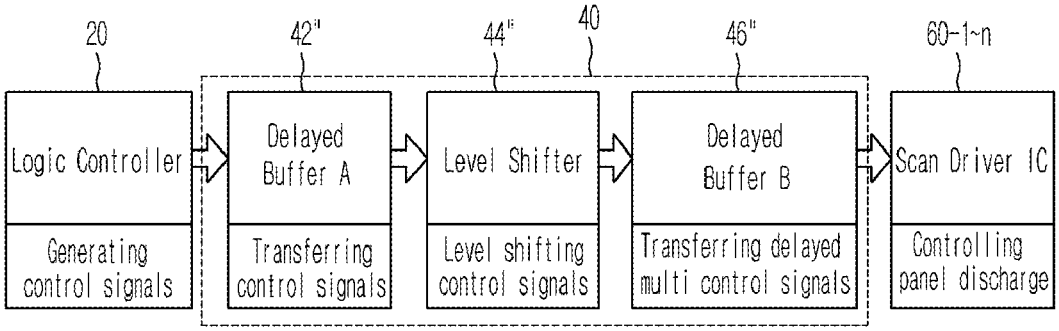

Also, as shown in FIGS. 9A to 9C, the buffer block 40 can include a first buffer 42 buffering the scan driver control reference signals input from the logic controller 20; a level shifter 44 for converting the signals of the first buffer into a level appropriate for the scan drivers; and a second buffer 46 buffering the output signals of the level shifter 44 to output them as the scan driver control signals for the scan drivers.

In the case of the buffer block 40 having the first buffer 42, the level shifter 44, and the second buffer 46, the delay time can be implemented in the first buffer 42 or the second buffer 46. Also, both the first buffer 42 and the second buffer 46 can be implemented to provide the delay time. In some embodiments, the delay of each of the first and second buffers 42 and 46 is identical. In other embodiments, the delay of each is different. For example, a rising transition at an input buffer, and a falling transition at an output buffer may provide the delay).

FIG. 9*a* shows the case where a delay structure is in the second buffer, FIG. 9*b* shows the case where a delay structure is in the first buffer, and FIG. 9*c* shows the case where a delay structure is in both the first and second buffers.

A buffer structure giving the delay time can be implemented using an analog circuit or a digital circuit.

Figure 10:
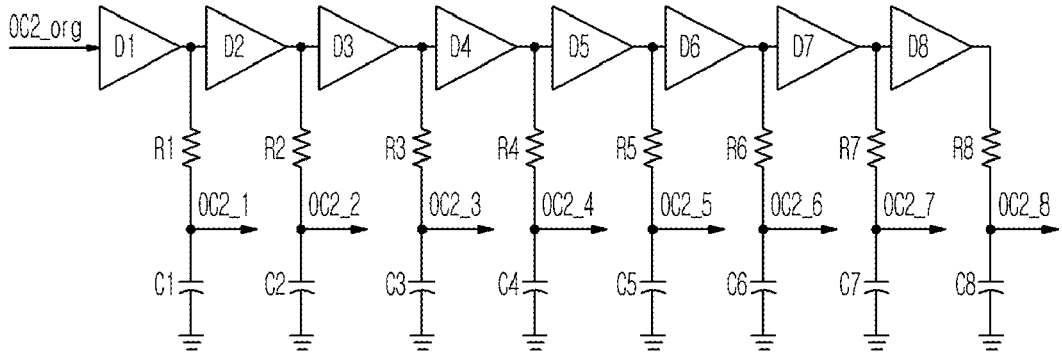
FIG. 10 is a circuit view showing an analog buffer structure.

FIG. 10 shows a multi-stage delay buffer structure implemented using an analog circuit. With a multistage analog amplifier (e.g.: operational amplifier) coupled in series as shown and a resistor and a capacitor as the load, the multi-stage delay buffer structure outputs signals of different delay times. In the shown structure, the respective delayed output signals OC2_1 to OC2_8 are taken from the terminals of the resistors and capacitors.

When being applied to the PDP control circuit, the input signal OC2_org in the multi-stage buffer structure as shown in FIG. 10 becomes the scan driver control reference signal output from the logic controller, and the output signals OC2_1 to OC2_8 are each applied to one of the eight scan driver groups.

Figure 11:
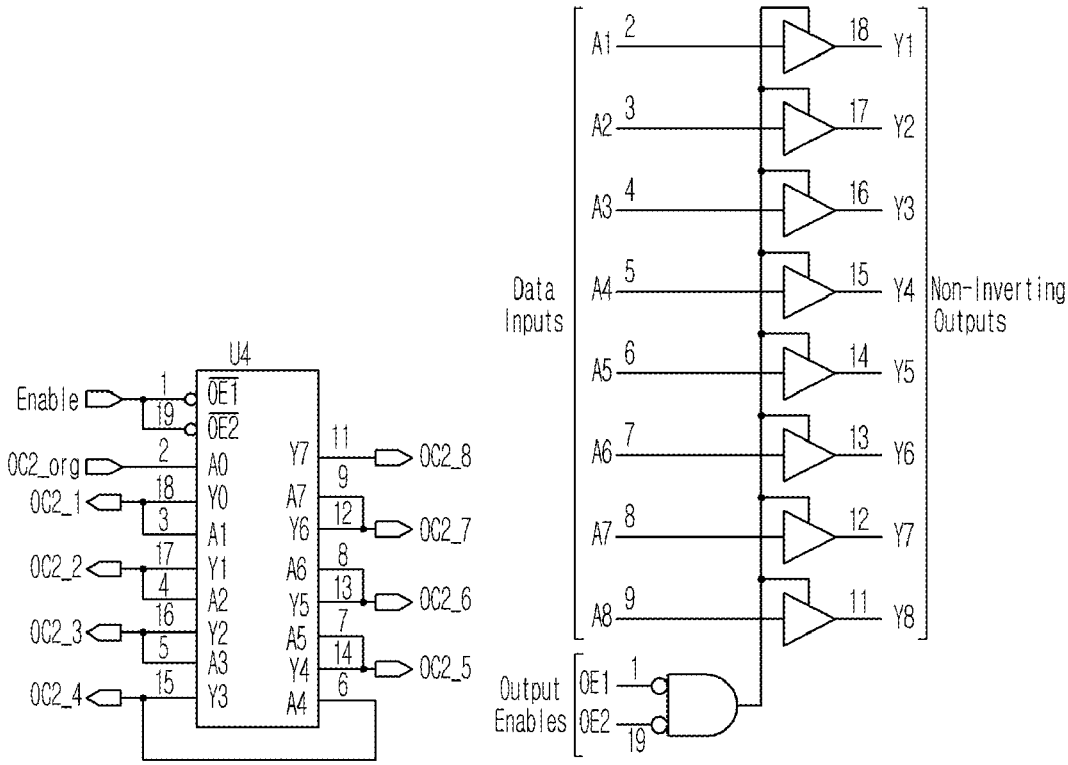
FIGS. 11 and 12 are construction views showing an IC for a buffer.
Figure 12:
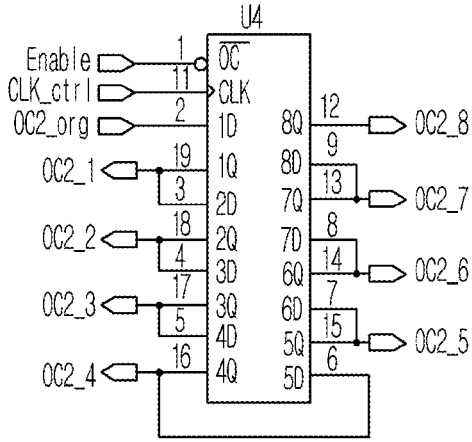
Figure 12:
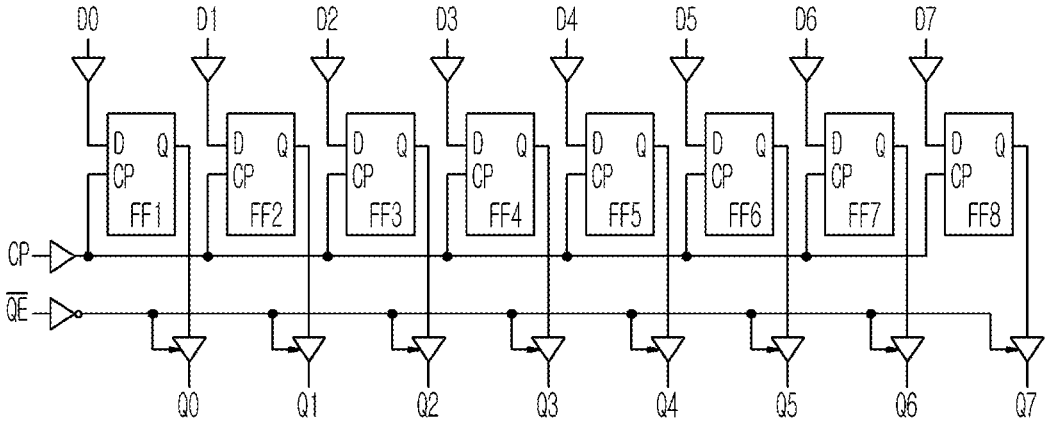

FIG. 11 shows a multi-stage delay buffer structure implemented using an IC for a buffer, and FIG. 12 shows a multi-stage delay buffer structure implemented using an IC for a D flip-flop register having a clocked buffer. The multi-stage delay buffer structure can be easily implemented using the IC chip for a non-inverted buffer having the shown structure or the IC for a D flip-flop register. However, in some embodiments, the output of the using IC is not sufficient for the scan., driver, it is desirable to be applied to only the first buffer prior to the level shifter.

Also, although not shown, a delay control structure may be used to allow some of the transitions for the scan driver controls signals, requiring the time delay, to pass by the delay buffer, and to allow the transitions not requiring the time delay to directly pass the scan driver control signals, without passing by the delay buffer.

To this end, separate delay control signals may be generated from the logic controller, and the buffered signals according to each of the delay control signals are output with delay or without delay from the buffer (first buffer and/or second buffer).

Figure 13:
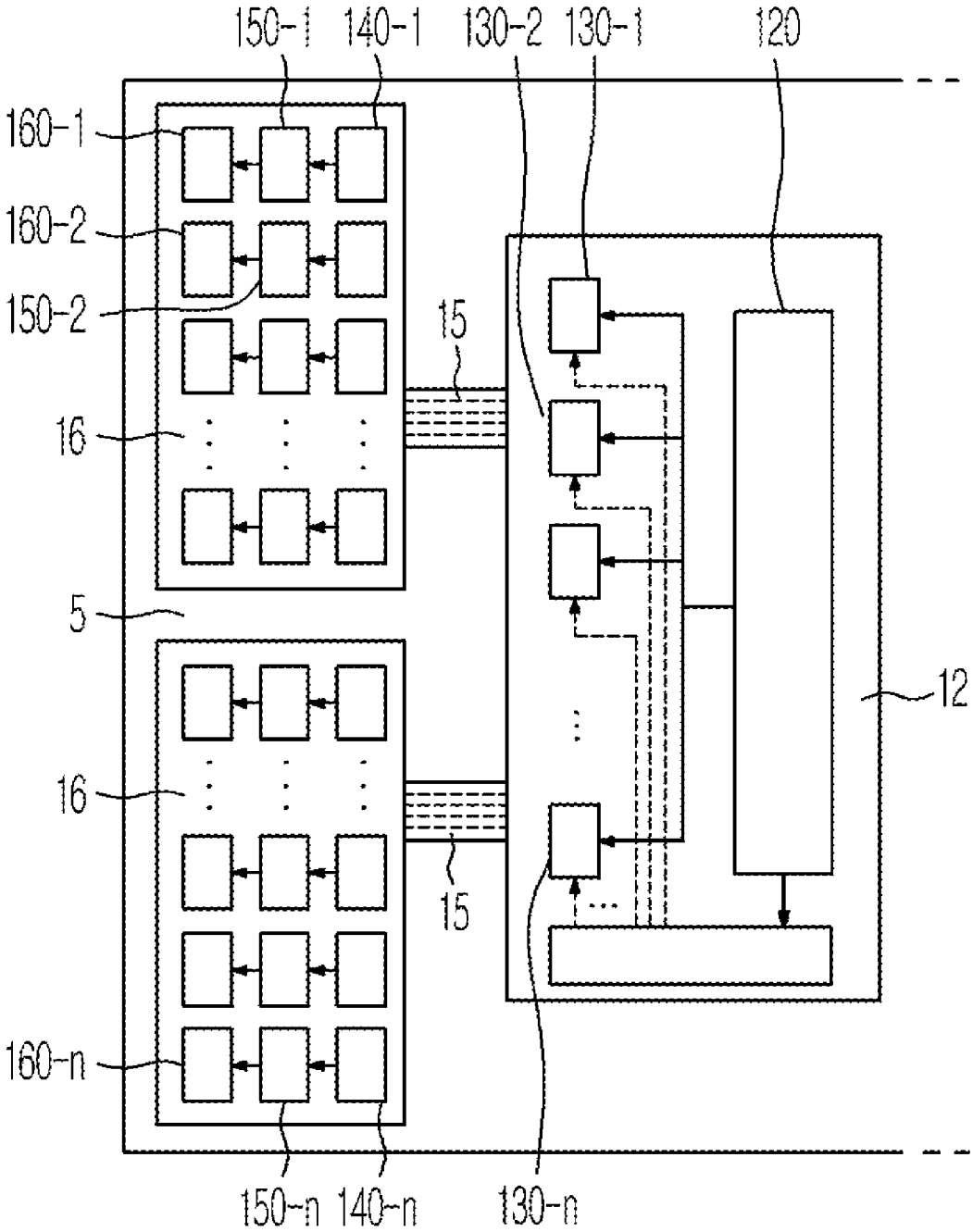
FIG. 13 is a construction view showing a PCB structure of a PDP driving circuit.

FIG. 13 shows a PCB structure on a rear of a plasma display device mounted with a PDP control circuit.

The plasma display device includes: a PDP (not shown); a chassis base 5 attaching and supporting the PDP; a driver board 16 installed on the chassis base 5 to include a plurality of scan drivers 160-1 to n generating driving signals for the electrode of the PDP; a controller board 12 installed on the chassis base 5 to include a logic controller 120 generating scan driver control reference signals; and a buffer block giving different delay times from each other according to each group to the scan driver control reference signals by dividing the plurality of scan drivers 160-1 to n having more than two groups to transfer them to the plurality of scan drivers 60-1 to n.

Herein, the buffer block can have: first buffers 130 buffering the scan driver control reference signals; level shifters 140-1 to n converting the signals from the first buffers 130-1 to n into a level appropriate for the scan drivers 160-1 to n; and second buffers 150-1 buffering the output signals from the level shifters 140-1 to n to output them to the scan drivers 160-1 to n.

In the controller board 12, the data transmission to the driver board 16 is made by means of a flexible printed circuit (FPC) 15 electrically connecting them. In the drawing, the data transmission path from the first buffers 130-1 to n to the level shifters 140-1 to n are implemented by means of the FPC. In the drawing, it is appreciated that the first buffers 130-1 to n are positioned on the controller board 12, and the level shifters 140-1 to n and the second buffers 150-1 to n are positioned on the driver board 16. Other devices for electrical connection and other arrangements may also be used.

The data transmission path from the level shifters to the second buffers can be implemented by means of the FPC. In this embodiment, the first buffers and the level shifters are positioned on the controller board, and the second buffers are positioned on the driver board.

A PDP driving method performed by the structure as shown in FIG. 8 will be described. The PDP driving method includes the steps of: forming scan driver control reference signals, which are digital signals, in a logic controller 20; transferring the scan driver control reference signals to the scan drivers 40-1 to n after applying delay time to at least one transition time point; forming scan driving signals, which are analog signals, according to the scan driver control reference signals delayed in the scan drivers 40-1 to n; and driving the PDP by applying the scan driving signals to the Y electrode of the PDP.

The operation of applying the delay time to the scan driver control reference signals is performed on the buffer block 40. When the buffer block 40 is implemented as in the structures as shown in FIGS. 9A to 9C, the method of operation may include the steps of: first buffering the scan driver control reference signals output from the logic controller; level shifting the first buffered signals; second buffering the level shifted signals; and transmitting the second buffered signals to the scan drivers.

Also, when the data transmission line between the first buffers and the level shifters is a bus line for a relatively long-distance data transmission such as flexible printed circuit (FPC), etc. in the structure as shown in FIGS. 9*a* to 9*c*, the first buffered signals after the first buffering may be transmitted from the board mounted with the logic controller to the board mounted with the scan drivers to perform the level shifting.

In addition, when the data transmission line between the level shifters and the second buffers is a bus line for a relatively long-distance data transmission such as flexible printed circuit (FPC), etc., the level shifted signals after the level shifting may be transmitted from the board mounted with the logic controller to the board mounted with the scan drivers to perform the second buffering.

Among the scan driver control reference signals, the transition time points that the delay time is applied to is the transition time point from a state 1 to a state 2 and the transition time point from a state 3 to a state 4 in the case of FIG. 7. Also, the application of the delay time can be performed in the steps of the first buffering and/or the second buffering.

The PDP driving control circuit and the driving method are capable of relieving the generation of large sudden current in the reset period of the scan driving signals used in the PDP driving.

Also, even though the size of the PDP may be very large, the circuitry and methods described herein can maintain the driving quality with additional buffers so that costs of the development and/or the mass production of a large-sized panels can be reduced.

Although a few embodiments of the present invention have been shown and described, it would be appreciated by those skilled in the art that changes might be made without departing from the principles and spirit of the invention.

What is claimed is:

1. A plasma display panel driving circuit, comprising:

a logic controller configured to generate a plurality of scan driver reset control reference signals;

a buffer block configured to receive the scan driver reset control reference signals and to generate at least three reset control signals based on the scan driver reset control reference signals, wherein each of the reset control signals has a selected one of at least three different selectable delay times; and a scan driver configured to drive a plurality of scan lines with reset driving signals, wherein the scan lines are divided into at least three groups, wherein the reset driving signals for each of the groups is based on one of the three reset control signals, and wherein the reset driving signals of each of the groups comprises:

a voltage ramp starting at a start voltage and ending at an end voltage, wherein the start and end voltages for each of the groups is substantially the same, and wherein the voltage ramp of each of the groups occurs at substantially the same time, a voltage transition to the start voltage, which occurs at a time based on the selected delay times of the reset control signals, and a voltage transition from the end voltage, which occurs at a time based on the selected delay times of the reset control signals.

2. The driving circuit as claimed in claim 1, further comprising a delay controller configured to allow delay for a transition to a first level for a rising ramp of a reset waveform and for a transition for a falling ramp of the reset waveform for the scan driver reset control reference signals.

3. The driving circuit as claimed in claim 1, wherein the buffer block comprises:

a first buffer configured to buffer the scan driver reset control reference signals;

a level shifter configured to convert the signals of the first buffer to a level appropriate for the scan driver; and a second buffer configured to buffer the output signals of the level shifter and to output the buffered output signals to the scan driver.

4. The driving circuit as claimed in claim 3, wherein at least one of the first buffer and the second buffer includes a D flip-flop.

5. The driving circuit as claimed in claim 3, wherein at least one of the first buffer and the second buffer includes a multi-stage operational amplifier.

6. A method of driving a plasma display panel comprising a logic controller and a plurality of scan drivers, the method comprising:

generating a plurality of scan driver reset control reference signals in a logic controller, the scan driver reset control reference signals being digital signals;

transferring the scan driver reset control reference signals to the scan drivers, each of the transferred signals having a selected one of at least three different selectable delay times in at least one transition time point;

generating a plurality of scan driving signals according to the transferred scan driver reset control reference signals, each of the scan signals having one of at least three different delay times according to the selectable delay times of the transferred scan driver reset control reference signals, wherein the scan signals comprises:

a voltage ramp starting at a start voltage and ending at an end voltage, wherein the start and end voltages of the scan signals for each of the selectable delay times is substantially the same, and wherein the voltage ramp of the scan signals for each of the selectable delay times occurs at substantially the same time, a voltage transition to the start voltage, which occurs at a time based on the selected delay times of the reset control reference signals, and a voltage transition from the end voltage, which occurs at a time based on the selected delay times of the reset control reference signals; and driving the plasma display panel according to the scan driving signals.

7. The driving method as claimed in claim 6, wherein transferring the scan driver reset control reference signals to the scan drivers comprises:

buffering the scan driver reset control reference signals output from the logic controller;

level shifting the buffered scan driver reset control reference signals;

buffering the level shifted signals; and transmitting the buffered level shifted signals to the scan driver.

8. The driving method as claimed in claim 7, further comprising applying a delay to at least one of the scan driver reset control reference signals, the buffered scan driver reset control reference signals, and the buffered level shifted signals.

9. The driving method as claimed in claim 7, further comprising transmitting the level shifted signals through the transmission line from a board mounted with the logic controller to a board mounted with the scan driver.

10. The driving method as claimed in claim 7, further comprising transmitting the first buffered signals through the transmission line from a board mounted with the logic controller to a board mounted with the scan driver.

11. A plasma display device comprising:

a plasma display panel including a plurality of discharge electrodes, each of the discharge electrodes belonging to one of more than two groups; and a driving circuit module configured to separately drive each of the groups of discharge electrodes with driving signals each including a reset waveform, an address waveform, and a sustain waveform, wherein the driving circuit module comprises a buffer block configured to generate a reset control signal for each of the groups wherein each of the reset control signals has a selected one of at least three different selectable delay times;

wherein the reset waveform of each of the groups comprises:

a voltage ramp starting at a start voltage and ending at an end voltage, wherein the start and end voltages for each of the groups is substantially the same, and wherein the voltage ramp of each of the groups occurs at substantially the same time, a voltage transition to the start voltage, which occurs at a time based on the selected delay times of the reset control signals, and a voltage transition from the end voltage, which occurs at a time based on the selected delay times of the reset control signals.

12. The plasma display device as claimed in claim 11, wherein the plasma display panel comprises a scan electrode, a sustain electrode, and an address electrode for each discharge cell.

13. The plasma display device as claimed in claim 11, wherein the driving circuit module comprises:

a driver board including a plurality of scan drivers configured to generate driving signals for the groups of discharge electrodes; and a controller board including a logic controller configured to generate scan driver reset control reference signals for the buffer block, wherein the buffer block is configured to generate the reset control signals based on the scan driver reset control reference signals.

14. The plasma display device as claimed in claim 13, wherein the buffer block comprises:

first buffers configured to buffer the scan driver reset control reference signals;

level shifters configured to convert the scan driver reset control reference signals from the first buffers into output signals having a level appropriate for the scan drivers; and second buffers configured to buffer the output signals from the level shifters and to output the buffered output signals to the scan drivers.

15. The plasma display device as claimed in claim 14, wherein the first buffers are positioned on the controller board, and the level shifters and the second buffers are positioned on the driver board.

16. The plasma display device as claimed in claim 14, wherein the first buffers and the level shifters are positioned on the controller board, and the second buffers are positioned on the driver board.

17. The plasma display device as claimed in claim 14, wherein at least one of the first buffers and the second buffers include a D flip-flop.

18. The plasma display device as claimed in claim 14, wherein at least one of the first buffers and the second buffers include a multi-stage operational amplifier.

19. The plasma display device as claimed in claim 13, wherein the buffer block further comprises a delay controller configured to allow delay for a transition to a first level for a rising ramp of the reset waveform and for a transition for a falling ramp of the reset waveform for the scan driver reset control reference signals.

20. The plasma display device as claimed in claim 13, wherein the controller board is electrically coupled to the driver board with a flexible printed circuit.

21. The plasma display device as claimed in claim 11, wherein the driving circuit module is configured to perform a method, comprising:

generating a plurality of scan driver reset control reference signals in a logic controller, the scan driver reset control reference signals being digital signals;

transferring the scan driver reset control reference signals to the scan drivers, each of the transferred signals having a selected one of at least three different selectable delay times in at least one transition time point;

generating scan driving signals according to the transferred scan driver reset control signals, each of the scan signals having one of at least three different delay times according to the selectable delay times of the transferred scan driver reset control signals; and driving the plasma display panel according to the scan driving signals.

* * * * *